US006626703B2

(12) United States Patent
Hsin

(10) Patent No.: US 6,626,703 B2
(45) Date of Patent: Sep. 30, 2003

(54) MULTIPURPOSE ADAPTOR WITH A UNIVERSAL SERIAL BUS CONNECTOR

(76) Inventor: Liao Sheng Hsin, No. 10, Alley 38, Lane 229, San Chun St., Shulin City, Taipei Hsien (TW)

( * ) Notice: Subject to any disclaimer, the term of this patent is extended or adjusted under 35 U.S.C. 154(b) by 0 days.

(21) Appl. No.: 10/062,762

(22) Filed: Feb. 5, 2002

(65) Prior Publication Data

US 2003/0148663 A1 Aug. 7, 2003

(51) Int. Cl.[7] ..... H01R 25/00
(52) U.S. Cl. ..... 439/638; 439/76.1; 439/500
(58) Field of Search ..... 439/638, 639, 439/76.1, 906, 687, 696, 910, 956, 500

(56) References Cited

U.S. PATENT DOCUMENTS 5,910,025 A * 6/1999 Mendolia ..... 439/76.1
6,253,183 B1 * 6/2001 Boucard ..... 704/272
6,375,057 B1 * 4/2002 Gorchian ..... 224/682
6,424,522 B1 * 7/2002 Lin et al. ..... 361/683
6,488,545 B1 * 12/2002 Meyer ..... 439/680

* cited by examiner

*Primary Examiner*—Tho D. Ta
(74) *Attorney, Agent, or Firm*—Rosenberg, Klein & Lee

(57) ABSTRACT

This invention provides a multipurpose USB connector for charging batteries of various portable electric apparatuses. A connector includes a main body, a circuit unit, an input connector, an output port, an output line, and a battery connecting base. The main body is a hollow casing consisting of a first half and a second half. The output connector, output port, and battery connecting base are electrically connected with the circuit board. The input connector is a universal serial bus (USB) connector.

10 Claims, 8 Drawing Sheets

MULTIPURPOSE ADAPTOR WITH A UNIVERSAL SERIAL BUS CONNECTOR

BACKGROUND OF THE INVENTION

1. Field of the Invention

The present invention relates to a multipurpose adaptor with a universal serial bus (USB) connector. More particularly, the present invention relates to a portable adaptor with a USB connector for charging batteries. In use, the portable adaptor with a USB connector may be electrically connected to a notebook or a dry battery.

2. Description of the Prior Art

As the information technology has been developed, there are many kinds of portable electric apparatuses such as notebooks, cell phones, and personal digital assistant (PDA) are widely used by people in this information age. In use, these portable apparatuses are powered by chargeable batteries such as lithium battery, NiMH battery, Ni-Cd battery. Typically, when the electric power of the batteries is low, these chargeable batteries are charged by using a charger to recover their power. However, the conventional chargers are not user friendly and big in size. Also, one specific charger is often suitable only for one of these kinds of commercial batteries.

Consequently, there is a strong need to provide a multipurpose adaptor with a USB connector for charging batteries of various portable electric apparatuses.

SUMMARY OF THE INVENTION

It is a primary object of the present invention to provide a multipurpose adaptor with a USB connector that is capable of connecting with a notebook or a dry battery. In use, the notebook or dry battery connected with the connector provides an electric apparatus to be charged with electric power. It is advantageous to use the present invention since the connector according to this invention provides more flexible charging options. Further, the adaptor according to the present invention is small in size, and therefore, it is more convenient to use and carry.

According to the claimed invention, the multipurpose adaptor with a universal serial bus (USB) connector, comprising a main body having a chamber therein; a circuit unit disposed in the chamber, the circuit unit comprises a circuit board; and an input connector, an output port, and a battery connecting base that are electrically connected with the circuit board, wherein the input connector is a universal serial bus (USB) connector.

It is to be understood that both the forgoing general description and the following detailed description are exemplary, and are intended to provide further explanation of the invention as claimed. Other advantages and features of the invention will be apparent from the following description, drawings and claims.

DETAILED DESCRIPTION OF THE PREFERRED EMBODIMENTS

Figure 1:
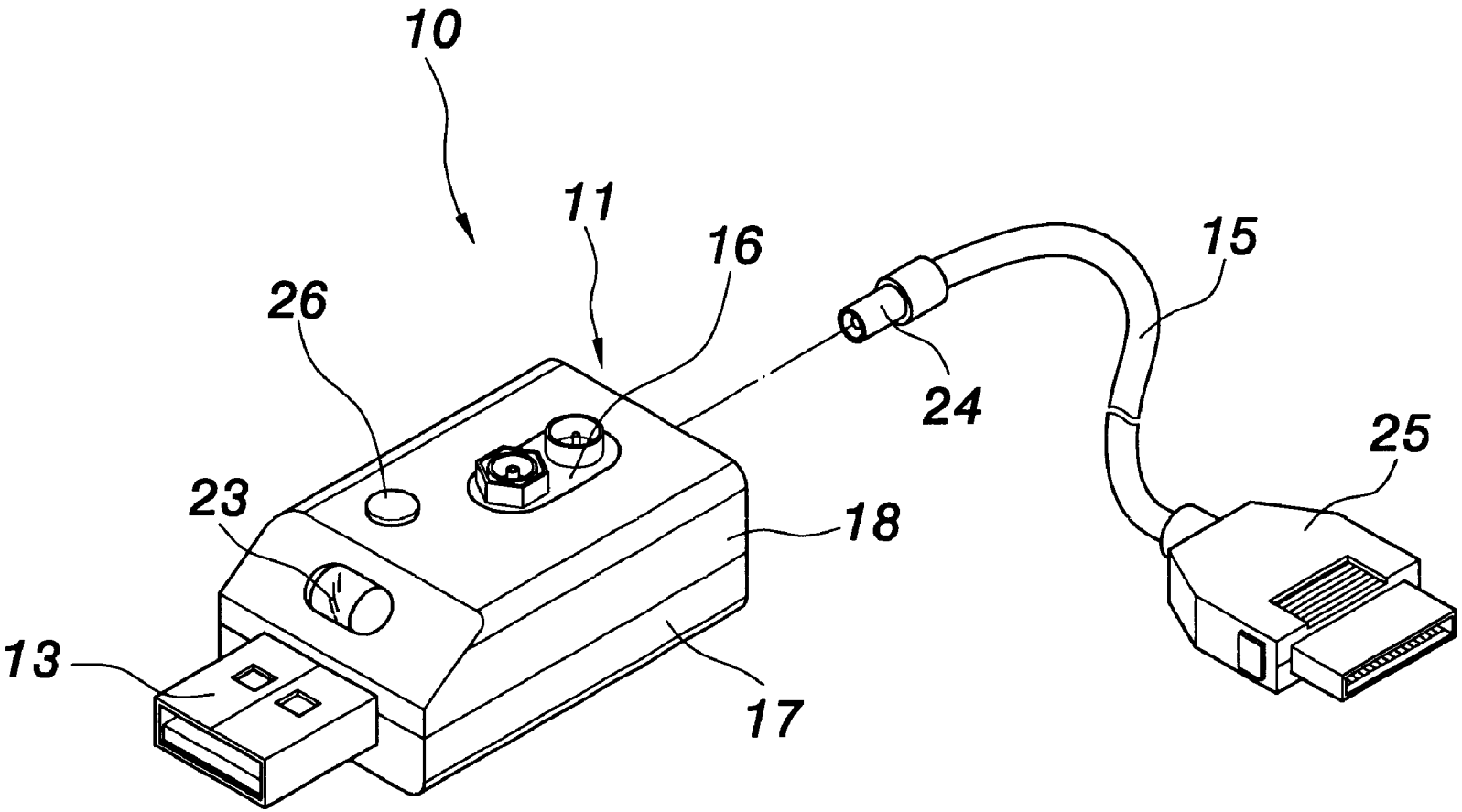
FIG. 1 to FIG. 3 are diagrams of the preferred embodiment according to the present invention.
Figure 2:
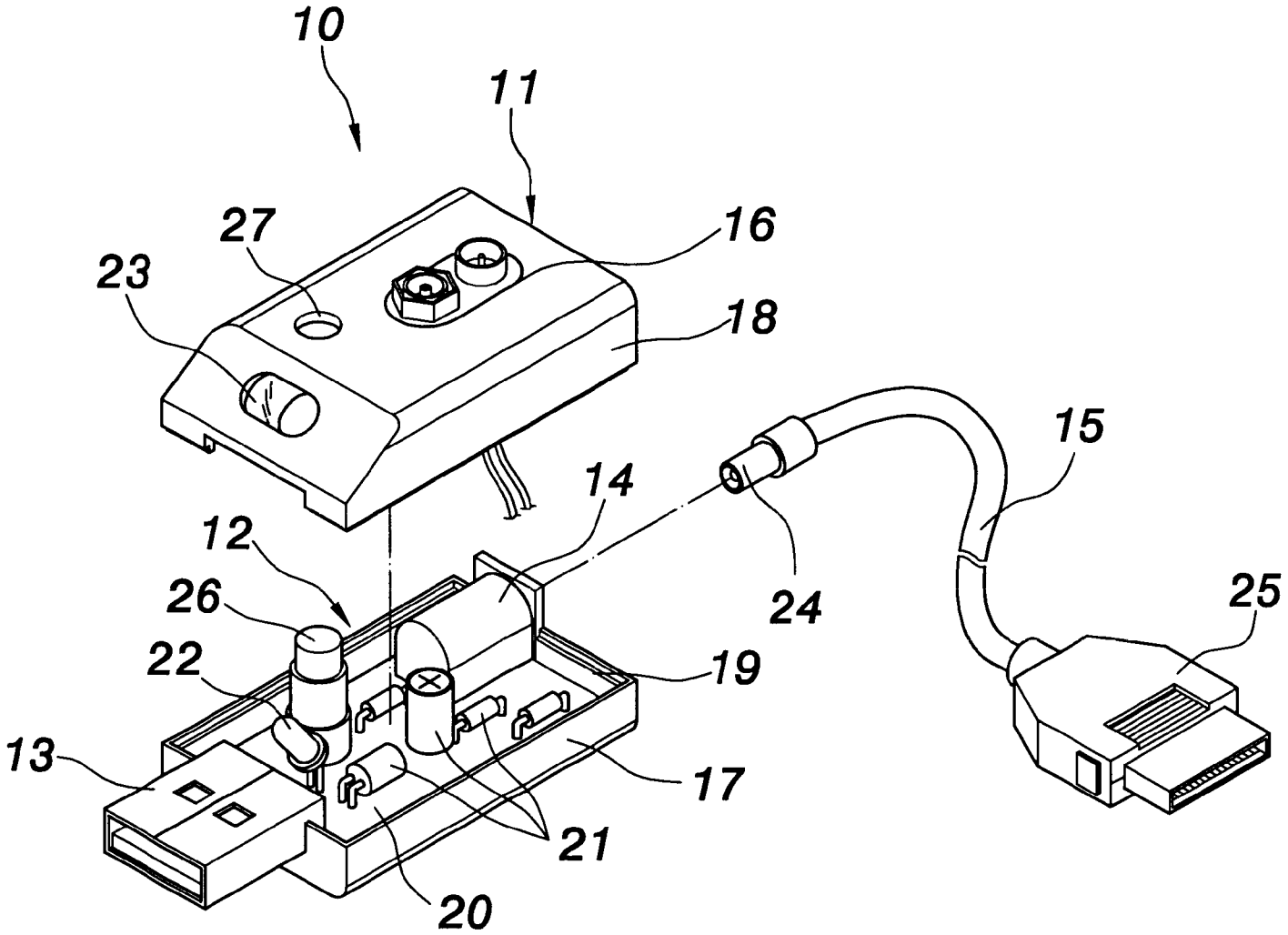
Figure 3:
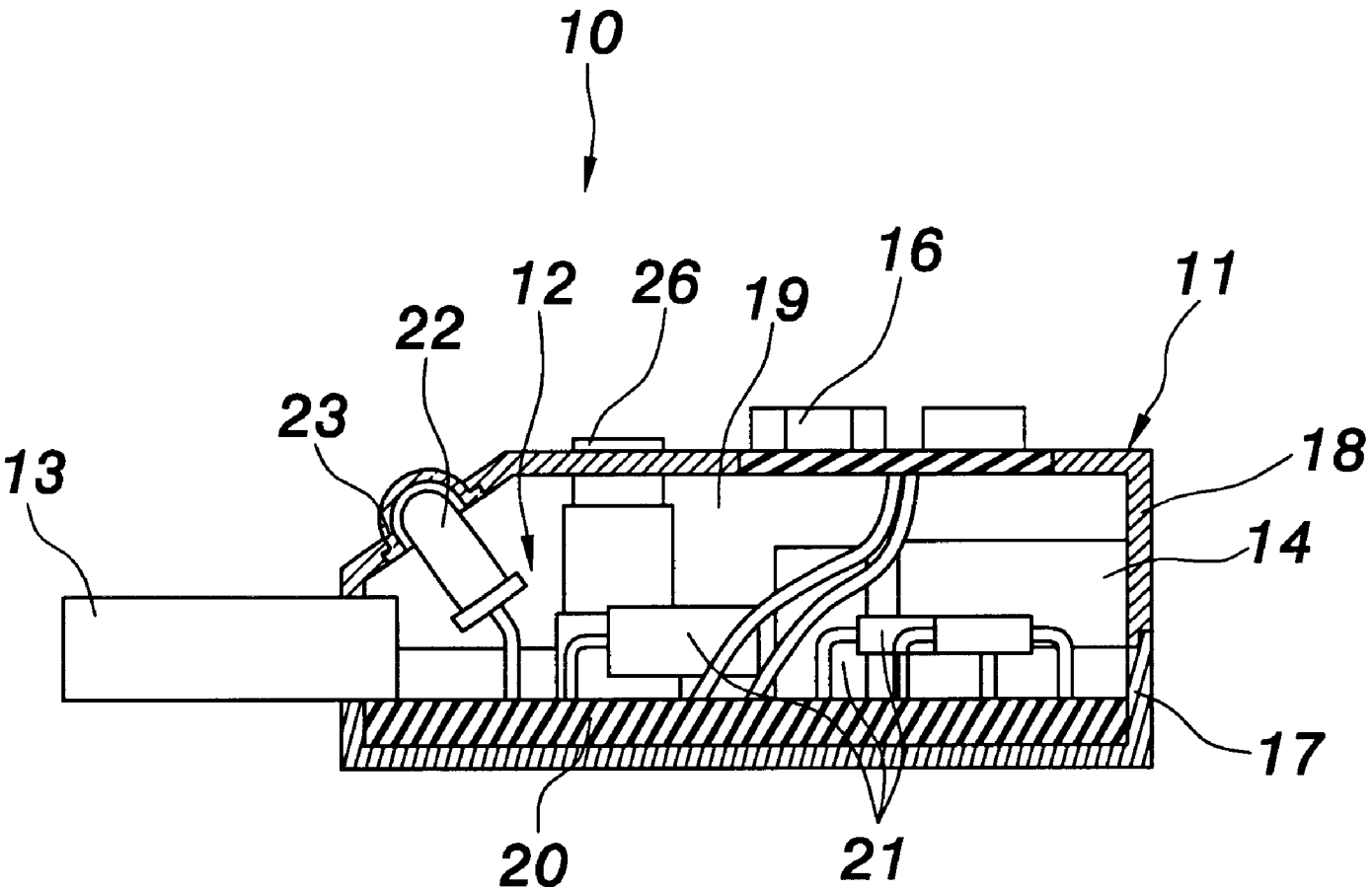

Referring to FIG. 1 to FIG. 3 of the preferred embodiment according to the present invention. This invention provides a multipurpose adaptor with a USB connector for charging batteries of various portable electric apparatuses. As shown in FIG. 1 to FIG. 3, connector 10 comprises a main body 11, a circuit unit 12, an input connector 13, an output port 14, an output line 15, and a battery connecting base 16. The main body 11 is a hollow casing consisting of a first half 17 and a second half 18. First half 17 and second half 18 are assembled by means of a mechanism known in the art such as buckles, screws, or ultrasonic melting process. A chamber 19 is defined by the hollow main body 11 for accommodating the circuit unit 12.

The circuit unit 12 comprises a circuit board 20 and a plurality of electric devices 21. The circuit unit 12 is disposed in the chamber 19. A light source 22 is positioned on the circuit board 20. Preferably, the light source 22 is LED or a light bulb. The light source 22 is used for lighting, displaying, or alarming. A light cover 23 or hole is located on the main body in a position corresponding to the light source 22. A switch 26 is disposed on the circuit board 20 and an opening 27 is formed on the main body 11 corresponding to the switch 26. The switch 26 protrudes from the surface of the main body 11 by penetrating through the opening 27. The switch 26 controls the on/off states of the light source 22.

The input connector 13, output port 14, and battery connecting base 16 are fixed on the main body 11 by mechanisms known in the art such as wedges, buckles or snapping mechanism, and are electrically connected with the circuit board 20. The input connector 13 and output port 14 are exposed for connecting with a notebook or a cell phone. The battery connecting base 16 is also exposed for connecting with a dry battery. The input connector 13 is a USB connector.

The output line 15 has one plug 24 that is connected with the output port 14. In this way, the output line 15 is electrically connected with the circuit board 20. The other end of the output line 15 is a connector 25 that is used to connect a portable device such as a cell phone.

Figure 4:
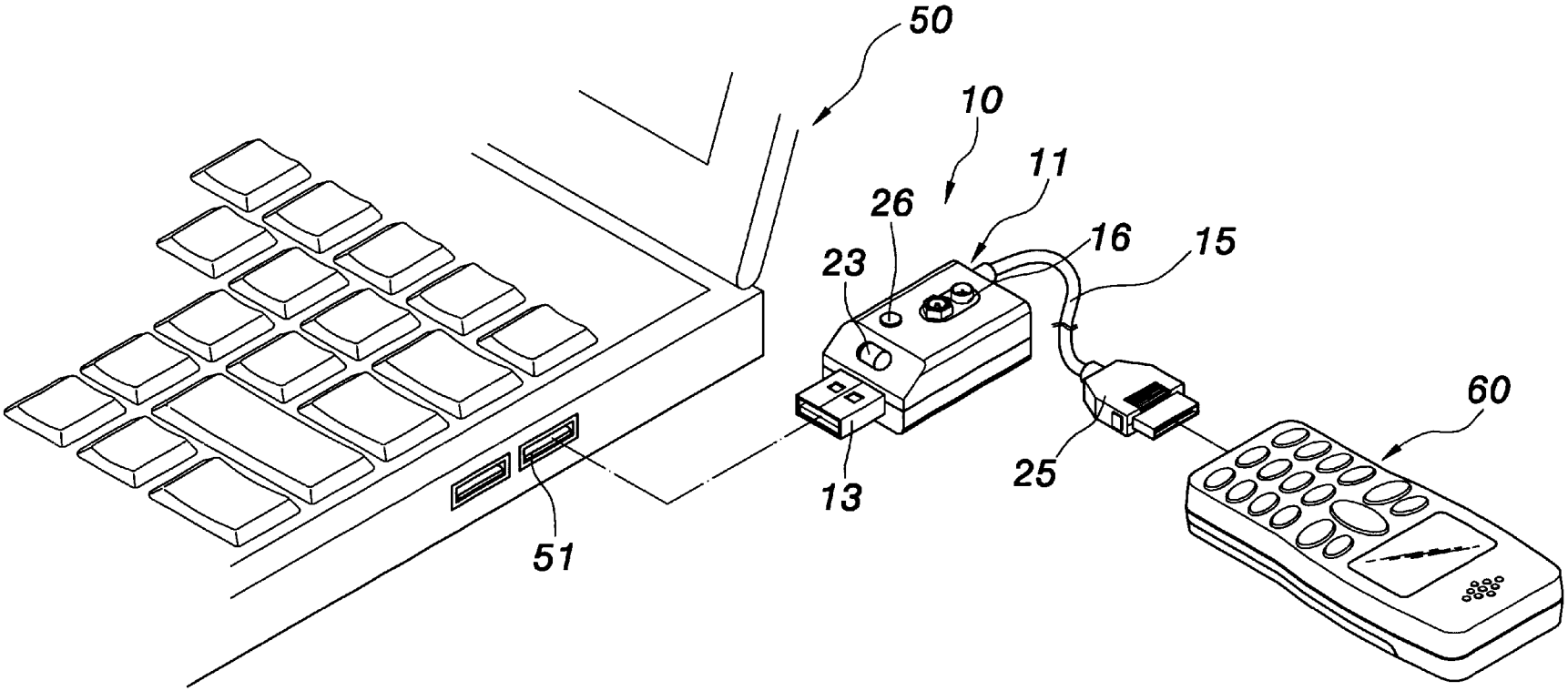
FIG. 4 is a perspective view illustrating the status of this invention when in use.

Referring to FIG. 4 of a schematic diagram exemplarily showing the use of this invention. In use, the input connector 13 is plugged in a DC output terminal 51 of the portable device 50, for example, a notebook. By this way, the input connector 13 is electrically connected with the portable device 50 that is capable of providing the connector 10 with electric power. A portable device 60 to be charged, for example, a cell phone, is plugged by the connector 25 of the output line 15 as indicated.

Figure 5:
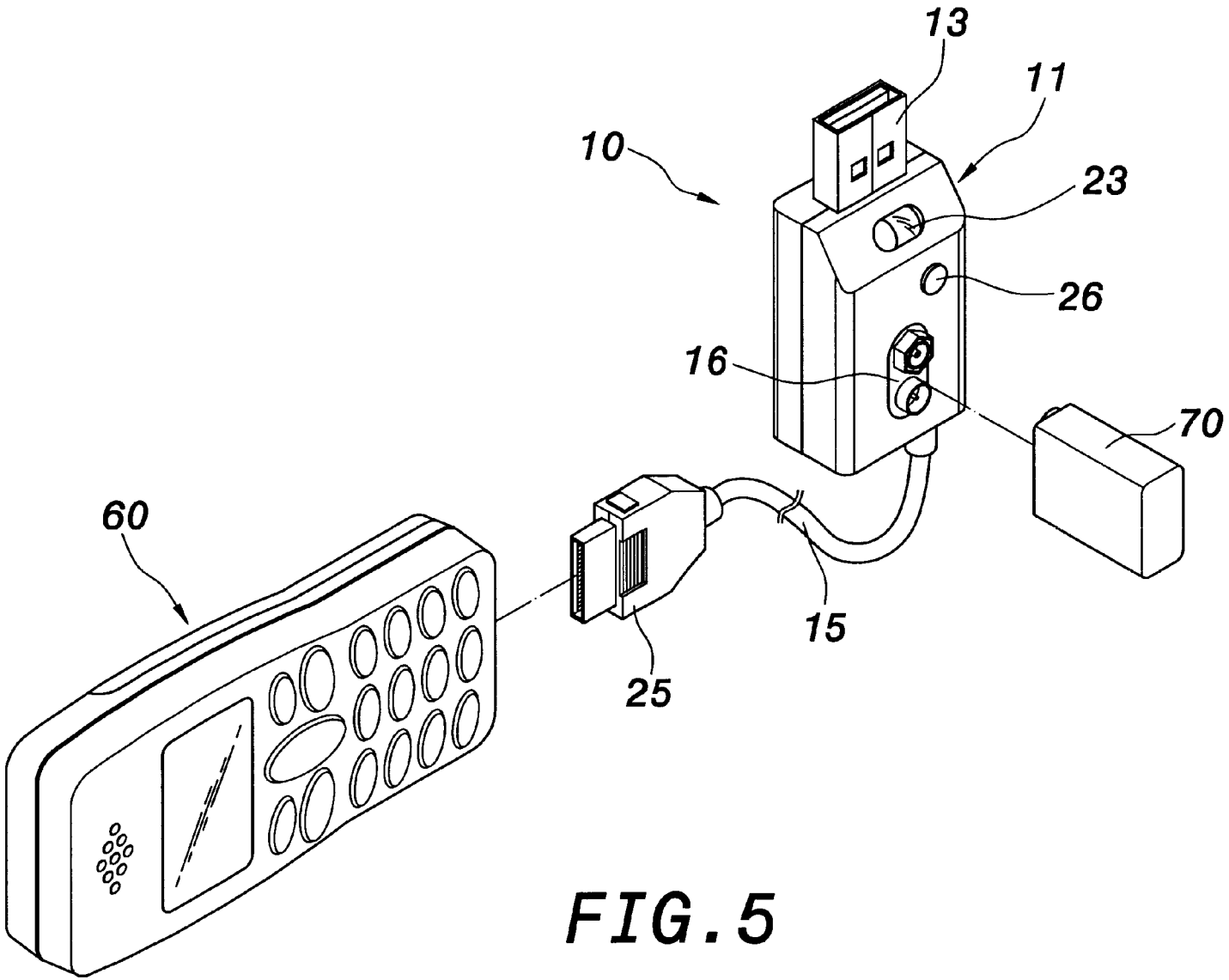
FIG. 5 is a perspective view illustrating the status of this invention when in use.

Referring to FIG. 5 of another schematic diagram exemplarily showing the use of this invention. As shown in FIG. 5, the connector 10 may be powered by a commercially available dry battery 70. In use, the dry battery 70 is electrically connected with the connecting base 16. A portable device 60 to be charged, for example, a cell phone, is plugged by the connector 25 of the output line 15 as indicated. It is convenient for a cell phone user to have this portable connector 60 that is capable of charging his or her cell phone by a dry battery.

Figure 6:
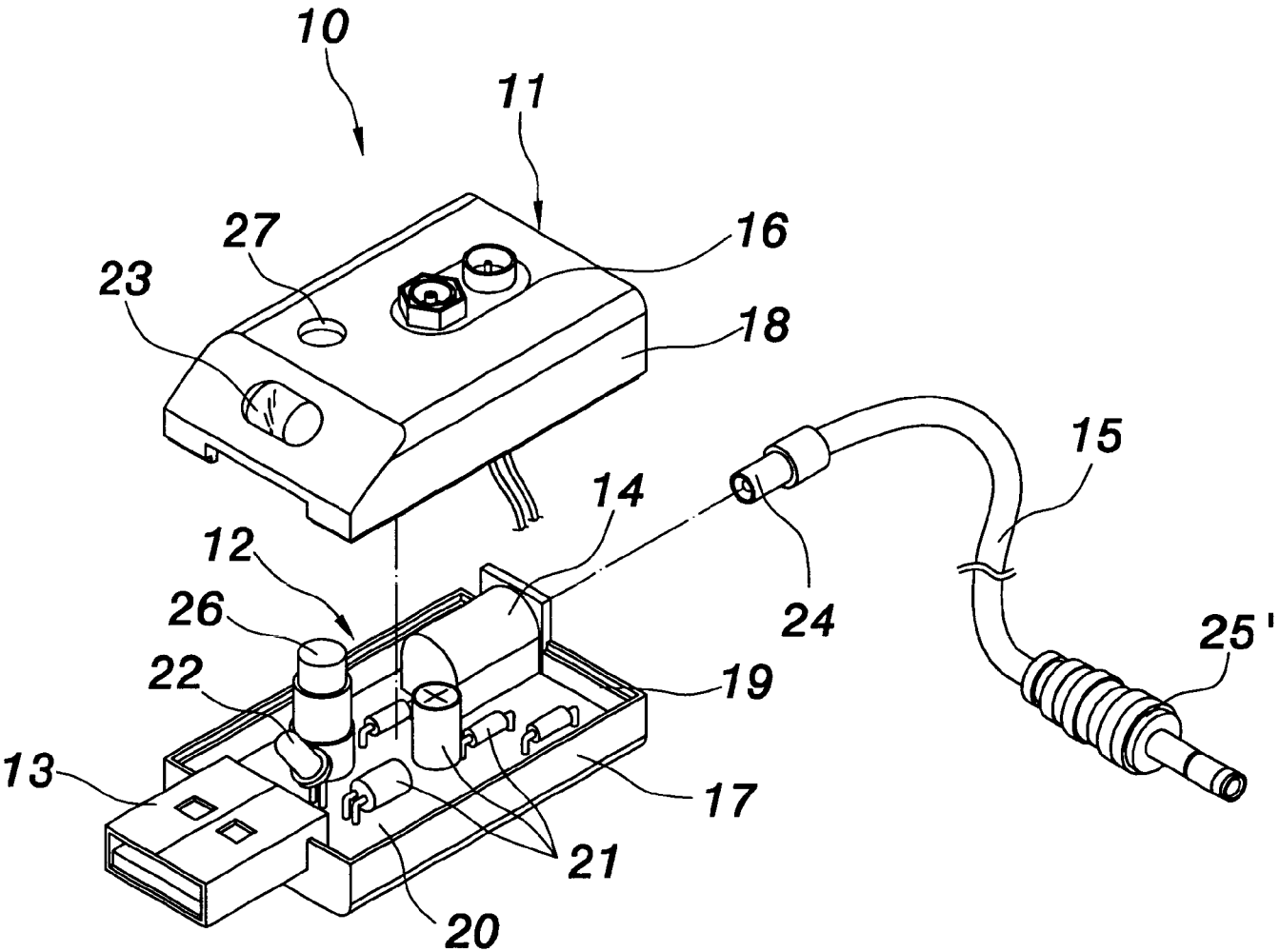
FIG. 6 is a perspective view of second embodiment according to this invention.
Figure 7:
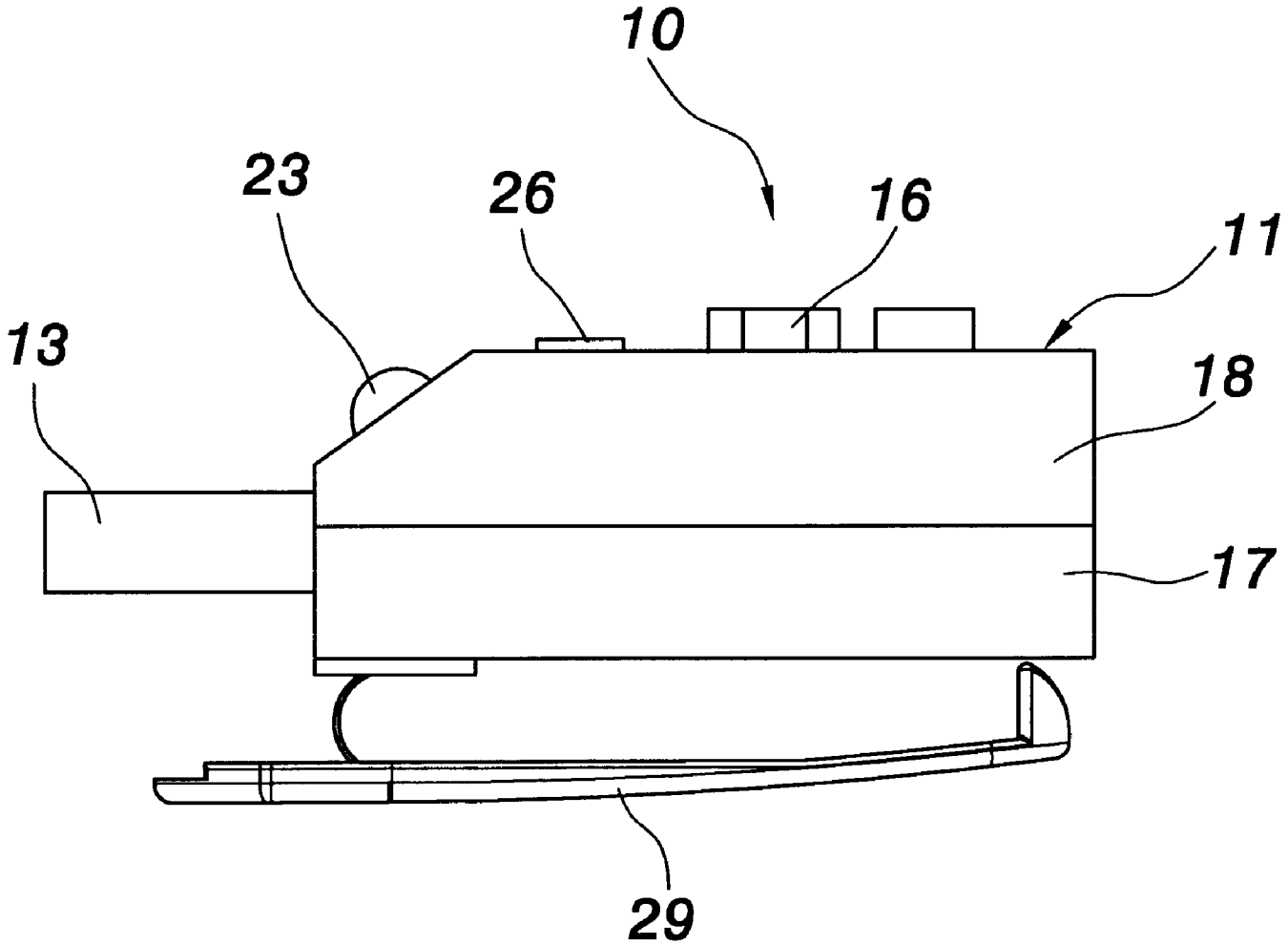
FIG. 7 is a schematic diagram of a third embodiment according to this invention.

Referring to FIG. 6 of a second preferred embodiment of this invention. As shown in FIG. 6, the connector 25' of the output line 15 may be replaced with different types of connectors. Referring to FIG. 7 of a third preferred embodiment of this invention. A clipping mechanism 29 may be formed on a wall of the main body 11. With this flexible clipping mechanism 29, a user may carry the connector 10 on his or her own belt or clothes.

Figure 8:
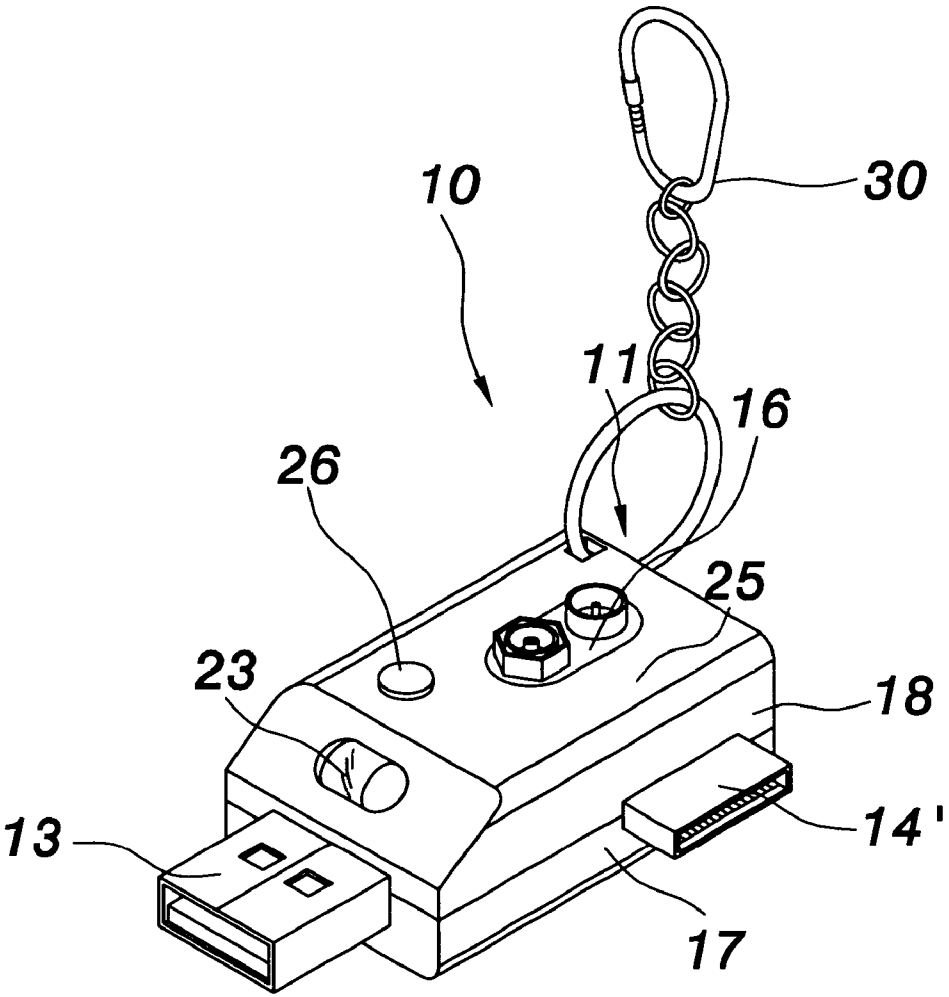
FIG. 8 is a schematic diagram of a fourth embodiment according to this invention.

Referring to FIG. 8 of a fourth embodiment according to this invention. As shown in FIG. 8, the output port 14' may be a typically connector. In this configuration, the cell phone to be charged can be directly plugged on the output port 14. Further, as indicated the main body 11 may combine with a key ring 30.

In short, the present provides a multipurpose connector for charging portable apparatuses such as a cell phone. The cell phone, for example, may be charged by a dry battery or a notebook through the specially designed connector 10. Moreover, the connector 10 according to this invention is small in size.

Those skilled in the art will readily observe that numerous modification and alterations of the device may be made while retaining the teachings of the invention. Accordingly, the above disclosure should be construed as limited only by the metes and bounds of the appended claims.

What is claimed is:

1. A multipurpose adaptor with a universal serial bus connector, comprising:

a main hollow body defining a chamber;

a circuit unit disposed in the chamber, the circuit unit having a circuit board;

an input connector in electrical communication with said circuit board;

an output port in electrical communication with said circuit board; and, a battery connecting base electrically connected with the circuit board, wherein the input connector is a universal serial bus connector for electrical connection to a first portable device, said output port being in electrical communication with a second portable device, said second portable device being selectively powered or recharged by either said first portable device or by a battery in electrical contact with said battery connecting base.

2. The multipurpose adaptor with a universal serial bus connector of claim 1 wherein the main body consists of a first half and a second half.

3. The multipurpose adaptor with a universal serial bus connector of claim 1 wherein a clipping mechanism is located on a wall of the main body.

4. The multipurpose adaptor with a universal serial bus connector of claim 1 wherein the main body is combined with a key ring.

5. The multipurpose adaptor with a universal serial bus connector of claim 1 wherein a switch is disposed on the circuit board and an opening is formed on the main body corresponding to the switch, wherein the switch protrudes from a surface of the main body by projecting through the opening, the switch controlling the on/off states of the light source.

6. The multipurpose adaptor with a universal serial bus connector of claim 1 wherein the input connector, output port, and battery connecting base are fixed on the main body.

7. The multipurpose adaptor with a universal serial bus connector of claim 1 wherein an output line is connected with the output port, and a plug connected at a first end of the output line is connected with the output port and a connector is connected at a second end thereof.

8. The multipurpose adaptor with a universal serial bus connector of claim 1 wherein the output port is a connector.

9. The multipurpose adaptor with a universal serial bus connector of claim 1 wherein the circuit board comprises a light source and the main body has a light cover or hole corresponding to the light source.

10. The multipurpose adaptor with a universal serial bus connector of claim 9 wherein the light source is a light emitting diode.

* * * * *